US010082762B2

(12) United States Patent
Ohashi

(10) Patent No.: US 10,082,762 B2
(45) Date of Patent: Sep. 25, 2018

(54) COVER MEMBER ATTACHMENT/DETACHMENT STRUCTURE AND IMAGE FORMING APPARATUS

(71) Applicant: KYOCERA Document Solutions Inc., Osaka (JP)

(72) Inventor: Hiroaki Ohashi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/463,123

(22) Filed: Mar. 20, 2017

(65) Prior Publication Data

US 2017/0300004 A1 Oct. 19, 2017

(30) Foreign Application Priority Data

Apr. 13, 2016 (JP) ..... 2016-080116

(51) Int. Cl.
*G03G 21/16* (2006.01)

(52) U.S. Cl.
CPC ..... *G03G 21/1633* (2013.01)

(58) Field of Classification Search
None
See application file for complete search history.

(56) References Cited

U.S. PATENT DOCUMENTS

2009/0049791 A1* 2/2009 Struthers ..... E04B 2/7457 52/741.1
2015/0098722 A1* 4/2015 Okauchi ..... G03G 21/1695 399/90

FOREIGN PATENT DOCUMENTS

JP 2014-142482 A 8/2014

* cited by examiner

*Primary Examiner* — Thomas Giampaolo, II
(74) *Attorney, Agent, or Firm* — Studebaker & Brackett PC

(57) ABSTRACT

A cover member attachment/detachment structure includes a first engagement part and a second engagement part. The first engagement part is formed in one of a portion to be protected or a cover member attached to the portion to be protected. The second engagement part is formed in the other of the portion to be protected or the cover member attached to the portion to be protected. The second engagement part is capable of engaging with the first engagement part. The first engagement part is made of magnetic material. The first engagement part is magnetically movable from an outside of the cover member without contact between a locking position where the first engagement part is engaged with the second engagement part and a lock releasing position where the first engagement part is disengaged with the second engagement part.

6 Claims, 7 Drawing Sheets

COVER MEMBER ATTACHMENT/DETACHMENT STRUCTURE AND IMAGE FORMING APPARATUS

INCORPORATION BY REFERENCE

This application is based on and claims the benefit of priority from Japanese Patent application No. 2016-080116 filed on Apr. 13, 2016, which is incorporated by reference in its entirety.

BACKGROUND

The present disclosure relates to an attachment/detachment structure of a cover member which is detachably attached to a portion to be protected and an image forming apparatus including the cover member attachment/detachment structure.

In an image forming apparatus, such as a copying machine and a printer, a portion where is not preferred to be touched by a user or a portion where adhesion of foreign substances is not desirable is covered with a detachable cover member. In addition, in order to prevent such a portion from being exposed easily, the cover member is attached to the portion by means which is difficult to detach it, such as a complicate snap-fit structure or a screw fastening structure.

An example of the image forming apparatus is provided with an auxiliary cover which closes an option device connecting opening formed in an exterior cover. In the image forming apparatus, a foldable bent part is formed near the opening. By folding the bent part, the auxiliary cover is held and fixed between the bent part and the exterior cover to close the opening .

However, even if the cover member is attached by the snap-fit structure, the screw fastening structure or the above bent part, the detachment of the cover member is not always inhibited. That is, if a somewhat complicated work is required, the cover member can be detached. On the other hand, if the detachment work of the cover member becomes complicate, a great deal of effort and time is required for detachment work of the cover member when it is necessary.

SUMMARY

In accordance with an aspect of the present disclosure, a cover member attachment/detachment structure includes a first engagement part and a second engagement part. The first engagement part is formed in one of a portion to be protected or a cover member attached to the portion to be protected. The second engagement part is formed in the other of the portion to be protected or the cover member attached to the portion to be protected. The second engagement part is capable of engaging with the first engagement part. The first engagement part is made of magnetic material. The first engagement part is magnetically movable from an outside of the cover member without contact between a locking position where the first engagement part is engaged with the second engagement part and a lock releasing position where the first engagement part is disengaged with the second engagement part.

In accordance with an aspect of the present disclosure, an image forming apparatus includes an image forming part, an apparatus main body, a portion to be protected, a cover member and a cover member attachment/detachment structure. The image forming part forms an image on a sheet. The image forming part is provided on the apparatus main body. The portion to be protected is formed on the apparatus main body . The cover member is attached to the portion to be protected. The cover member attachment/detachment structure detachably attaches the cover member to the portion to be protected.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to the attached drawings, a cover member attachment/detachment structure and an image forming apparatus according to an embodiment of the present disclosure will be described.

Figure 1:
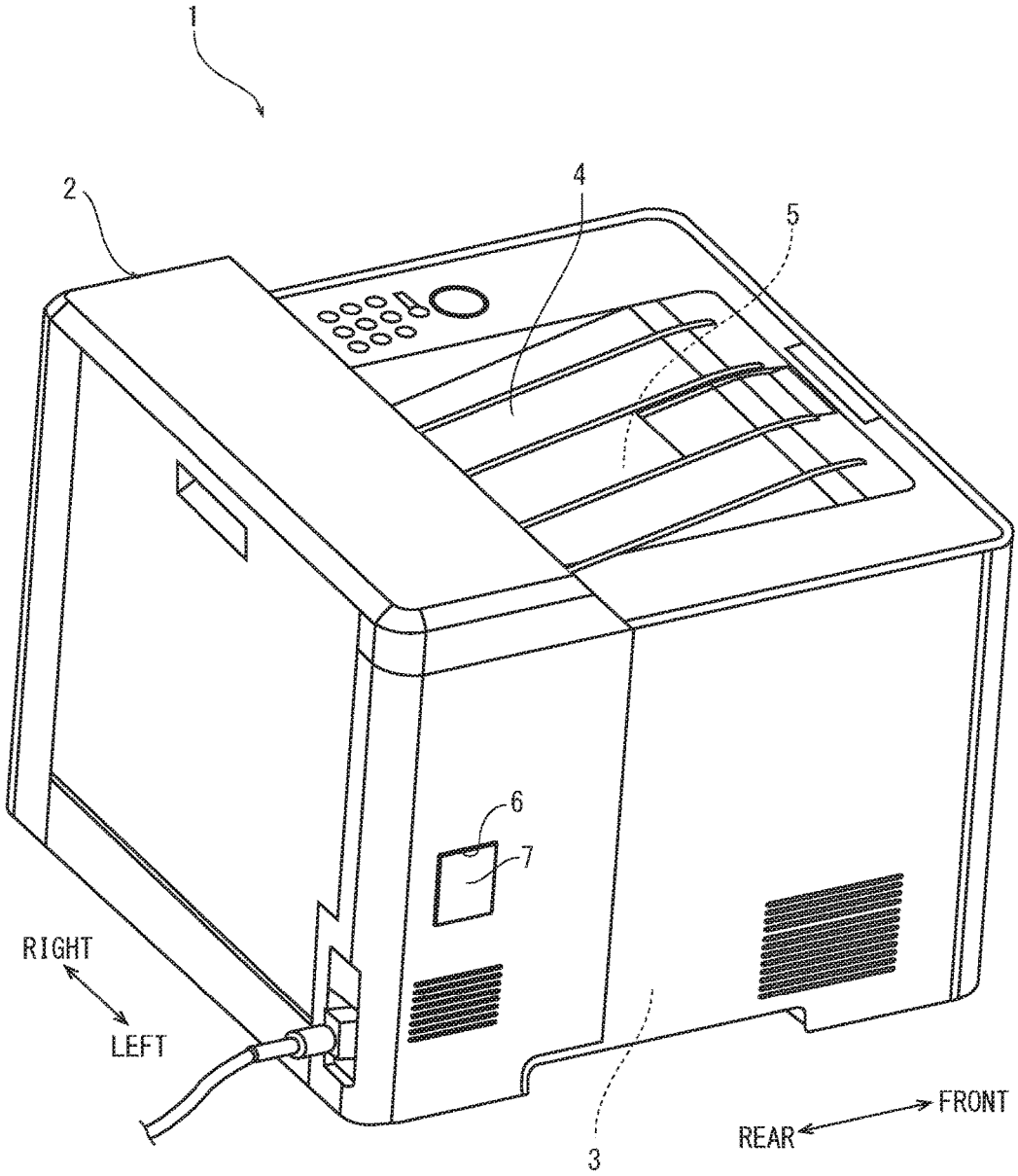
FIG. 1 is a rearward perspective view schematically showing a color printer according to an embodiment of the present disclosure.

With reference to FIG. 1, a color printer 1 as an image forming apparatus will be described. FIG. 1 is a rearward perspective view showing the color printer 1. In the following description, front, rear, left and right directions shown in FIG. 1 respectively show front, rear, left and right directions of the color printer 1.

As shown in FIG. 1, the color printer 1 includes a rectangular parallelepiped shaped apparatus main body 2. In a lower portion of the apparatus main body 2, a sheet feeding cassette 3 in which a sheet is stored is attached. On an upper face of the apparatus main body 2, an ejection tray 4 is formed. The apparatus main body 2 is provided with an image forming part 5, a sheet conveying path and a control part. The image forming part 5 forms an image on the sheet using four colors of toner in an electrophotographic manner. The conveying path is formed from the sheet feeding cassette 3 to the ejection tray 4 through the image forming part 5. The control part executes an image forming operation and a sheet conveying operation such that the sheet fed from the sheet feeding cassette 3 is conveyed along the conveying path, the image forming part 5 forms an image on the sheet and then the sheet is ejected to the ejection tray 4.

On a left side face of the apparatus main body 2, a recessed part 6 is formed. In the recessed part 6, a port for connecting an optional device is formed. The recessed part 6 is closed with a detachable cover member 7 in order to prevent entering of foreign substances.

Figure 2:
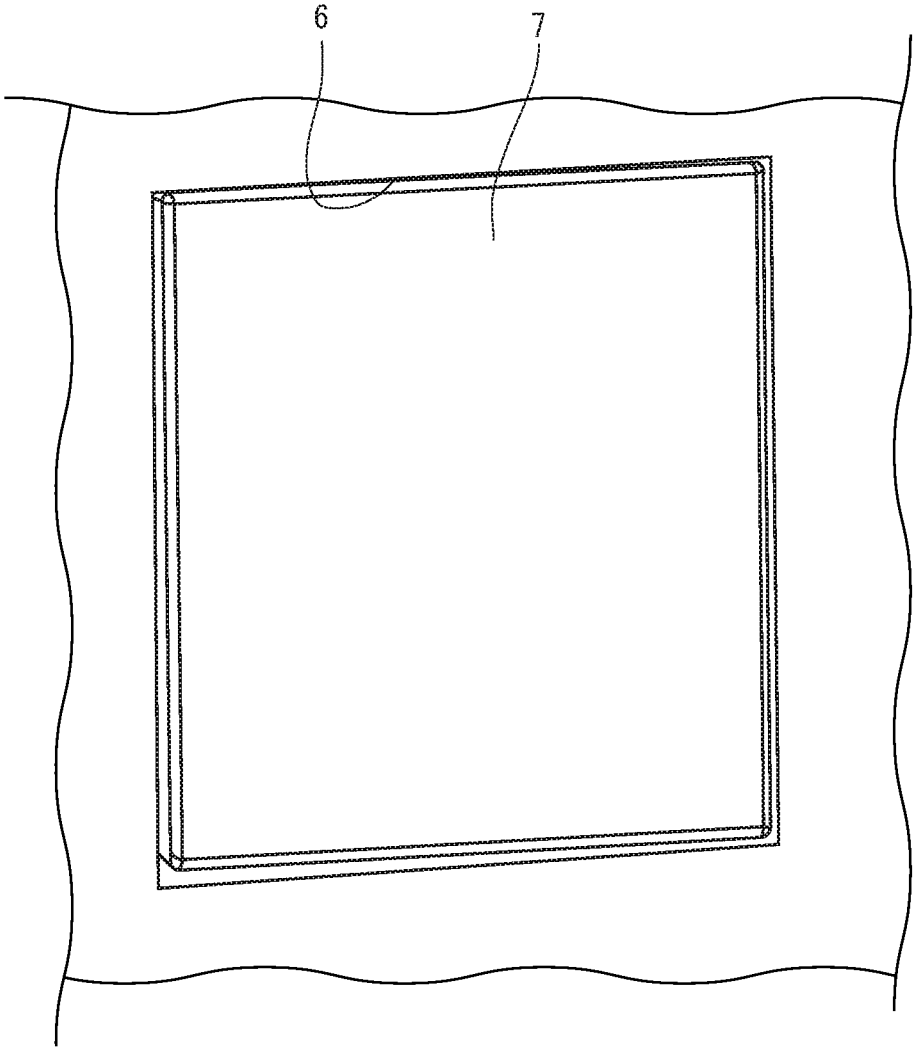
FIG. 2 is a perspective view showing a recessed part to which a cover member is attached, in the color printer according to the embodiment of the present disclosure.
Figure 3:
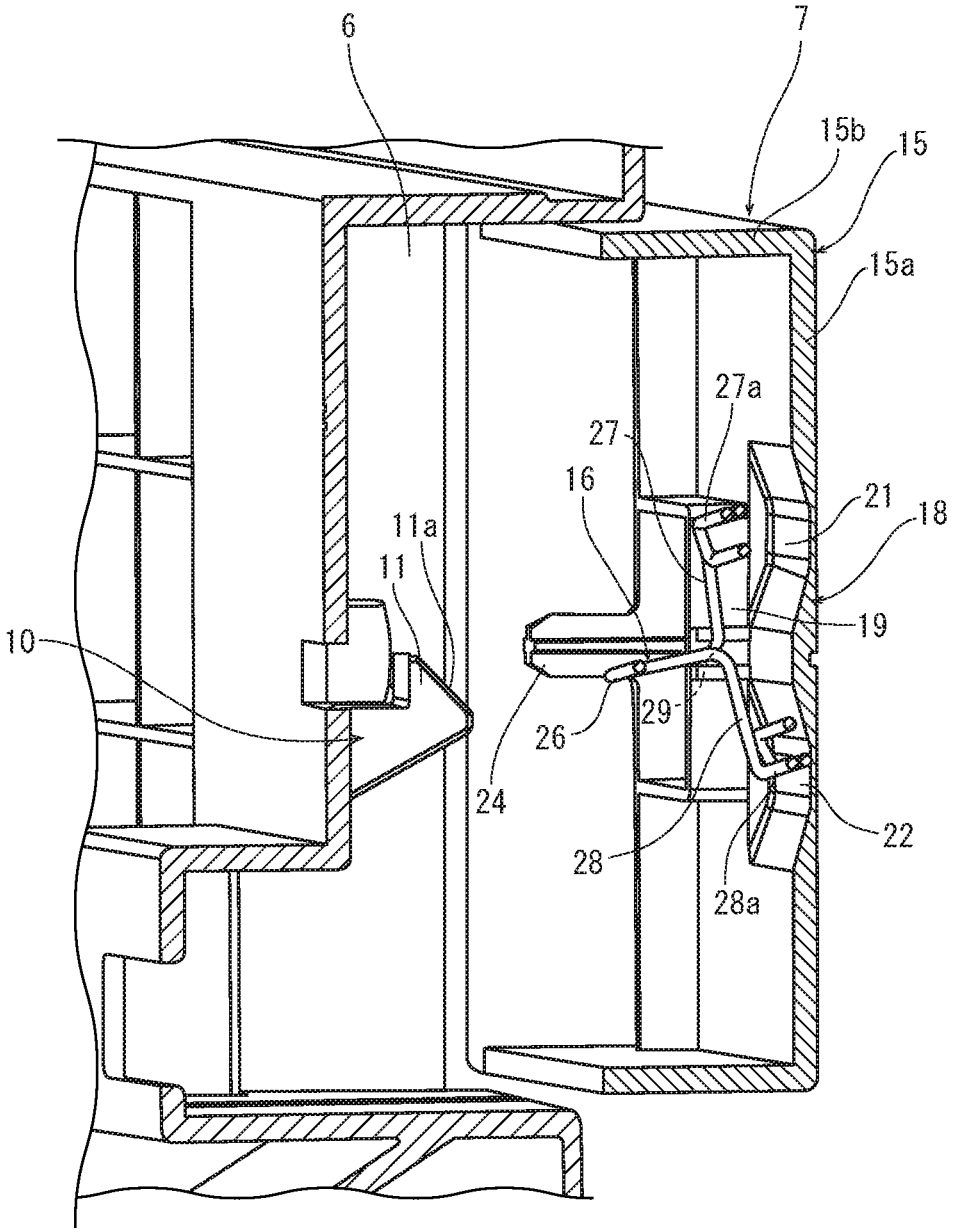
FIG. 3 is a perspective sectional view showing the recessed part and the cover member, in the color printer according to the embodiment of the present disclosure.
Figure 4:
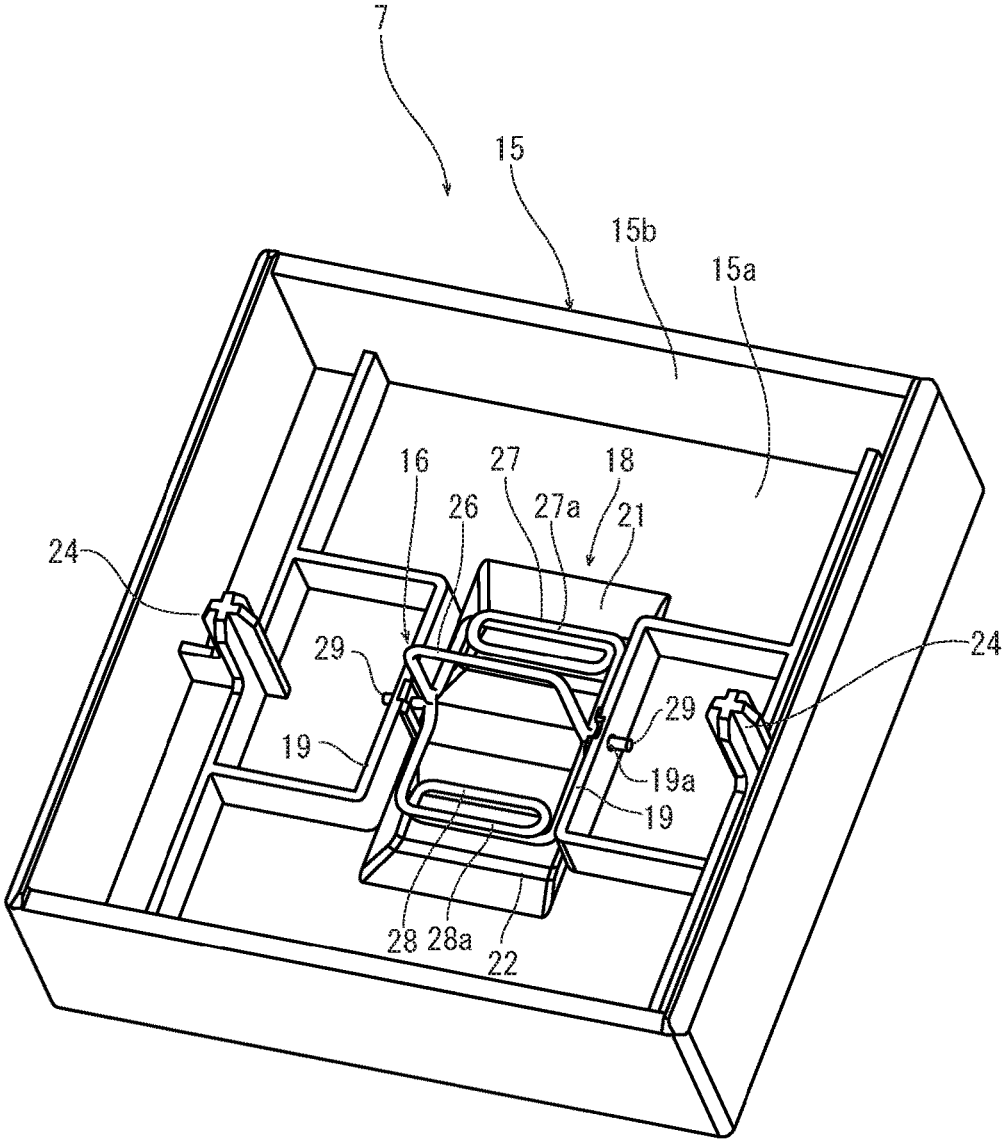
FIG. 4 is a perspective view showing an inner face of the cover member, in a cover member attachment/detachment structure according to an embodiment of the present disclosure.

With reference to FIGS. 2 to 4, an attachment/detachment structure of the cover member 7 to the recessed part 6 will be described. FIG. 2 is a perspective view showing the cover member 7 attached to the recessed part 6. FIG. 3 is a sectional perspective view showing the recessed part 6 and the cover member 7. FIG. 4 is a perspective view showing the cover member 7.

As shown in FIG. 2, the recessed part 6 is formed into a rectangular shape in a front view. As shown in FIG. 3, on a center portion of a bottom face of the recessed part 6, a hook claw 10 as a second engagement part is provided. On a tip end of the hook claw 10, an upward claw portion 11 is formed. The claw portion 11 has an inclined face 11*a* inclined upward in a depth direction of the recessed part 6. On the bottom face of the recessed part 6, positioning holes (not shown) are formed on the left and right sides of the hook claw 10.

As shown in FIG. 3 and FIG. 4, the cover member 7 includes a cover part 15 capable of fitting into the recessed part 6 and a lock member 16 as a first engagement part.

The cover part 15 has a rectangular base portion 15*a* and an outer circumferential portion 15*b* stood around an outer circumference of the base part 15*a*. The cover part 15 is made of nonmagnetic resin, for example. On a center portion of an inner face of the base portion 15*a*, a supporting area 18 to which the lock member 16 is supported so as to be turnable is formed. The supporting area 18 has a pair of vertical ribs 19, an upper recessed portion 21 and a lower recessed portion 22. The vertical ribs 19 are stood on the base portion 15*a* at a predetermined interval. The upper recessed portion 21 and the lower recessed portion 22 are arranged in the vertical direction between the vertical ribs 19. The vertical ribs 19 are each formed with an axis hole 19*a* at the middle between the upper recessed portion 21 and the lower recessed portion 22. The axis holes 19*a* are coaxially formed at the center of the vertical ribs 19 in the height direction . The upper recessed portion 21 and the lower recessed portion 22 are each formed into a shallow semicircle shape in a side view.

On the inner face of the base portion 15*a*, bosses 24 are stood on the left and right sides of the supporting area 18.

The lock member 16 is formed by folding a wire made of magnetic material, for instance. The lock member 16 has a pair of axis parts 29 as a turning shaft, a hook part 26, an upper arm part 27 and a lower arm part 28. The hook part 26, the upper arm part 27 and the lower arm part 28 each protrude in a radial direction from the pair of axis parts 29. The upper arm part 27 and the hook part 26 are crossed at substantially right angles around the pair of axis parts 29. The lower arm part 28 and the hook part 26 are crossed at substantially right angles around the pair of axis parts 29.

The hook part 26 is formed by folding a middle portion of the wire into a substantially U-shape (a channel-shape). The upper arm part 27 is formed by winding the wire on one side of the middle portion into a substantially circle one and a half times. The lower arm part 28 is formed by winding the wire on the other side of the middle portion into a substantially circle one and a half times. The upper and lower arm part 27 and 28 have respectively tip end portions 27*a* and 28*a* formed by the one and half times wound wire. The pair of axis parts 29 is formed by bending both end portions of the wire in opposing directions.

The pair of axis parts 29 is rotatably supported by the pair of axis holes 19*a* of the vertical ribs 19 of the supporting area 18. Thereby, the hook part 26 is turned in the vertical direction around the pair of axis parts 29. In addition, the upper arm part 27 and the lower arm part 28 are turned around the pair of axis parts 29 like a seesaw. When the hook part 26 is turned upward, the upper and lower arm parts 27 and 28 are turned in the clockwise direction in FIG. 3, and the tip end portion 27*a* of the upper arm part 27 enters the upper recessed portion 21 while the tip end portion 28*a* of the lower arm part 28 is separated from the lower recessed portion 22. On the other hand, when the hook part 26 is turned downward, the upper and lower arm parts 27 and 28 are turned in the counterclockwise direction in FIG. 3, and the tip end portion 27*a* of the upper arm part 27 is separated from the upper recessed portion 21 while the tip end portion 28*a* of the lower arm part 28 enters the lower recessed portion 22.

Figure 5:
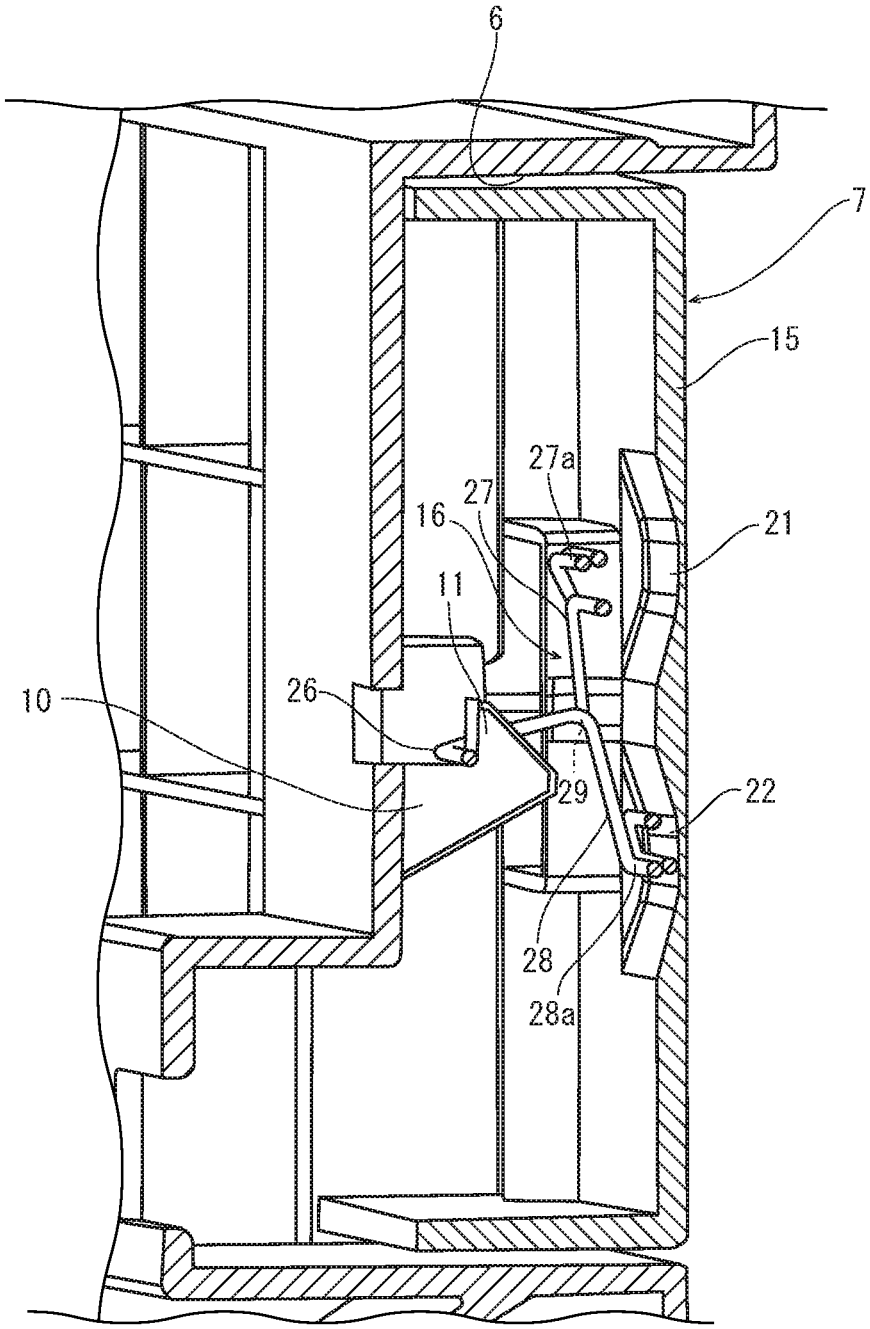
FIG. 5 is a perspective sectional view showing a lock member and a hook claw which are engaged with each other, in the cover member attachment/detachment structure according to the embodiment of the present disclosure.
Figure 6:
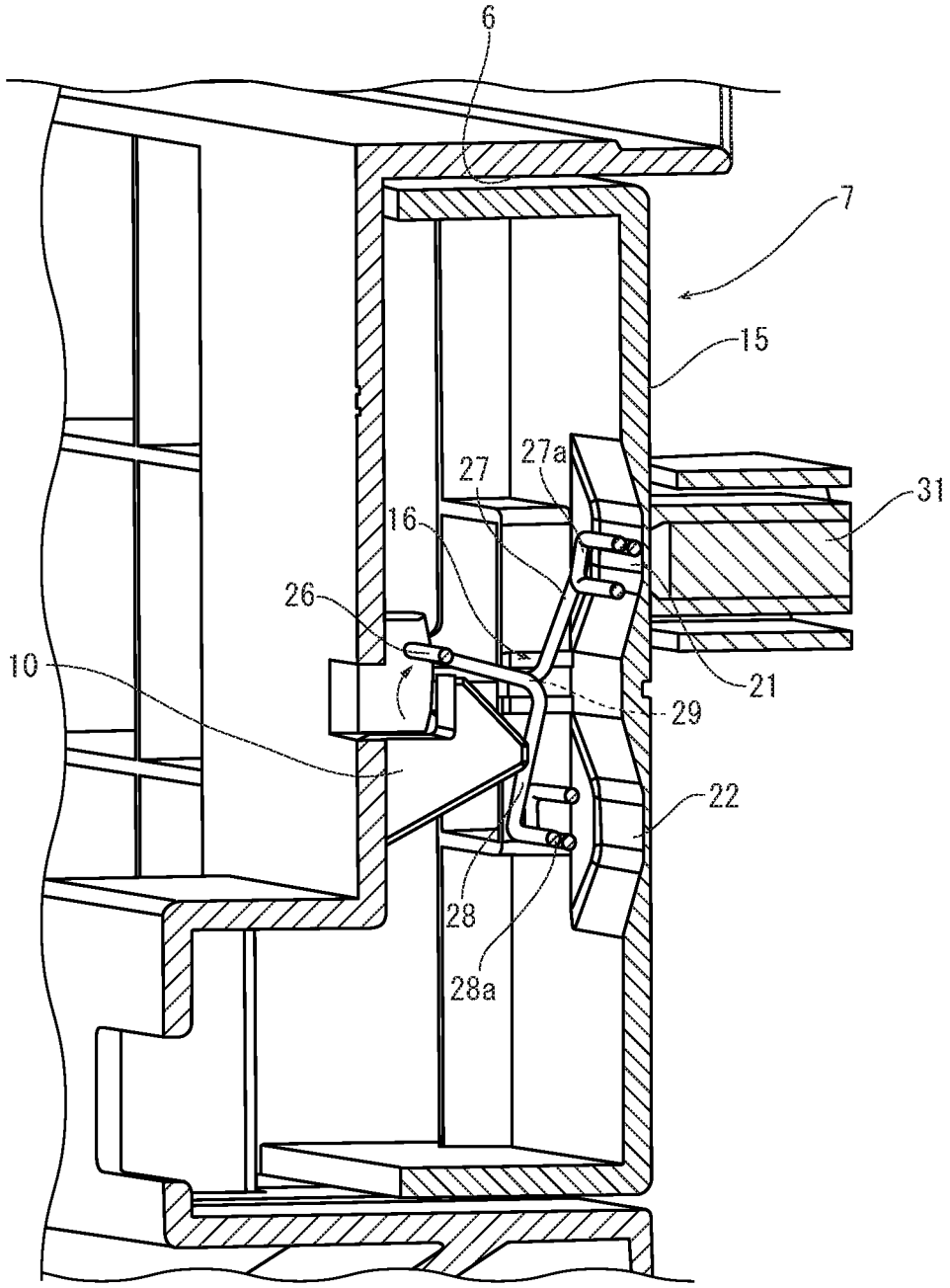
FIG. 6 is a perspective sectional view showing the lock member and the hook claw which are disengaged, in the cover member attachment/detachment structure according to the embodiment of the present disclosure.
Figure 7:
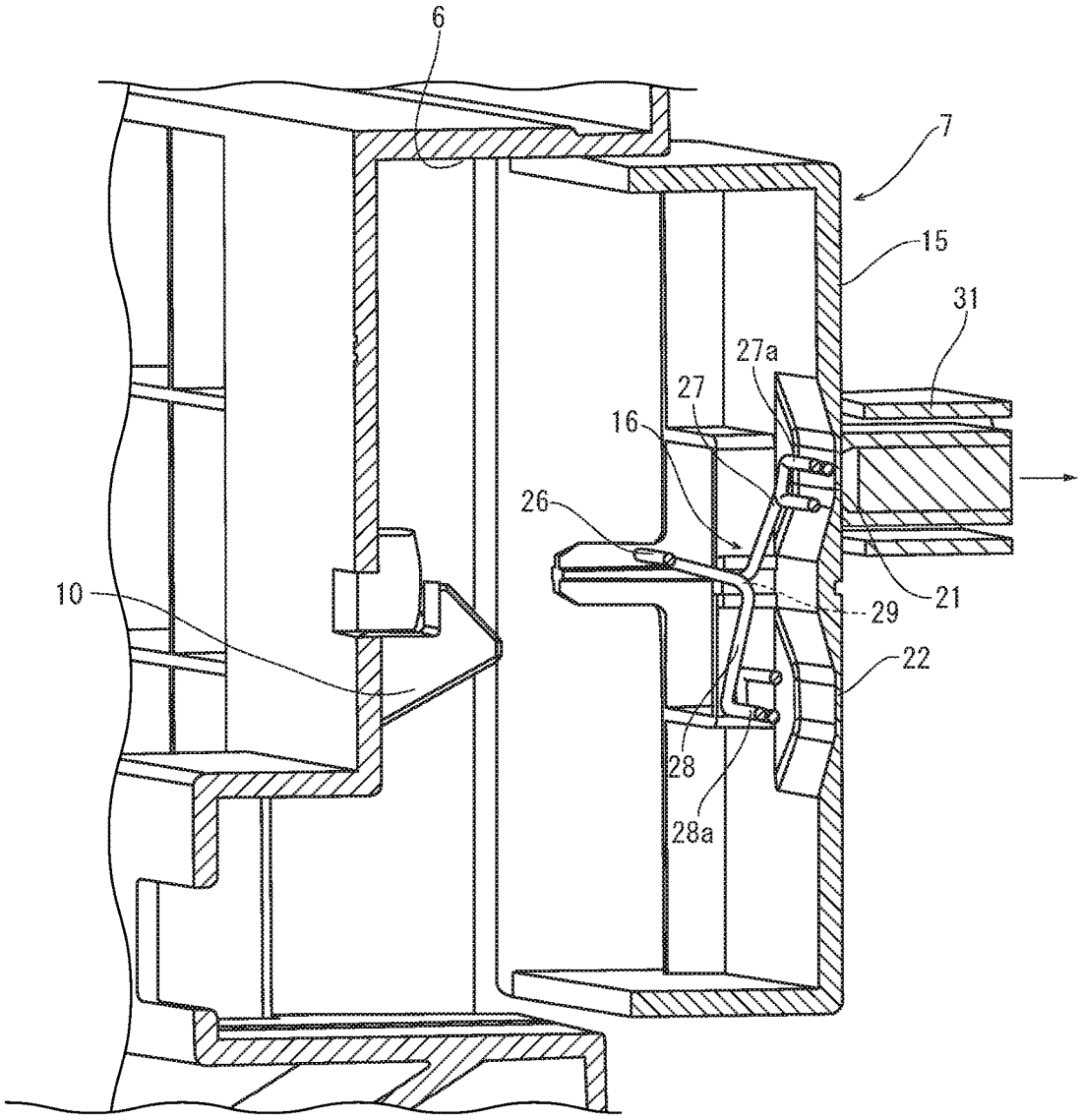
FIG. 7 is a perspective sectional view showing the cover member detached from the recessed part, in the cover member attachment/detachment structure according to the embodiment of the present disclosure.

With reference to FIG. 3 and FIGS. 5 to 7, an attachment and detachment operation of the cover member 7 to the recessed part 6 of the apparatus main body 2 will be described. FIG. 5 is a perspective sectional view showing the lock member 16 and the hook claw 10 which are engaged with each other. FIG. 6 is a perspective sectional view showing the lock member 16 and the hook claw 10 which are disengaged. FIG. 7 is a perspective sectional view showing the cover member 7 detached from the recessed part 6.

When the cover member 7 is attached to the recessed part 6, the cover part 15 of the cover member 7 is fitted into the recessed part 6. In this time, as shown in FIG. 3, the hook part 26 of the lock member 16 is turned downward by its own weight.

In the middle of the fitting of the cover part 15 into the recessed part 6, the hook part 26 of the lock member 16 comes in contact with the inclined face 11*a* of the hook claw 10 of the recessed part 6 and then runs up along the inclined face 11*a*. This turns the hook part 26 upward around the pair of axis parts 29. After reaching an upper edge of the inclined face 11*a*, the hook part 26 is turned downward around the pair of axis parts 29 by its own weight. As a result, as shown in FIG. 5, the hook part 26 is engaged with the claw portion 11 so that the lock member 16 is engaged with the hook claw 10 (a locking position). In addition, the downward turning of the hook part 26 turns the upper and lower arm parts 27 and 28 such that the upper arm part 27 is separated from the upper recessed portion 21 while the lower arm part 28 enters the lower recessed portion 22 . At the same time, the bosses 24 are fitted in the positioning holes. In this way, the cover member 7 is attached to the recessed part 6.

When the cover member 7 is detached from the recessed part 6, as shown in FIG. 6, a magnet 31 having a magnetic polarity opposite to the magnetic polarity of the lock member 16 is made to be approached the upper recessed portion 21 from an outside of the cover part 15. Then, the magnet 31 attracts the tip end portion 27*a* of the upper arm part 27, and the upper and lower arm parts 27 and 28 are turned such that the upper arm part 27 enters the upper recessed portion 21 while the lower arm part 28 is separated from the lower recessed portion 22. Thereby, the hook part 26 is turned upward to be separated from the claw portion 11 so that the lock member 16 is disengaged with the hook claw 10 (a lock releasing position). In this state, the cover member 17 is held between the upper arm part 27 and the magnet 31 by magnetic attraction between the upper arm part 27 and the magnet 31.

After that, when the magnet 31 is separated from the recessed part 6, as shown in FIG. 7, the cover member 7 is detached from the recessed part 6 together with the magnet 31 so that the recessed part 6 can be opened.

As described above, in the attachment/detachment structure of the cover member 7 of the present disclosure, once the cover member 7 is attached to the recessed part 6, it is impossible to detach the cover member 7 unless using the magnet 31. In other words, only a specified person who knows the use of the magnet 31 can detach the cover member 7. Accordingly, it is only required to make the use of the magnet 31 known to a service man or a technical operator. A general user hardly has an idea that the use of the magnet 31 allows the detachment of the cover member 7, and thus the cover member 7 can be prevented from being detached carelessly. On the other hand, the use of the magnet 31 enables to detach the cover member 7 easily.

In addition, because the lock member 16 is moved without contact from the outside of the cover part 15, as shown in FIG. 2, once the cover member 7 is attached to the recessed part 6, a portion where becomes a clue for detaching the cover member 7, such as a screw hole or a projection, is not exposed. Accordingly, the cover member 7 can be surely prevented from being detached carelessly.

In addition, the use of magnet 31 which is readily available can move the lock member 16 without contact. Furthermore, the lock member 16 can be formed by using a readily available magnetic wire. The magnet 31 may have the same magnetic polarity as that of the lock member 16. In this case, when the cover member 7 is detached, the magnet 31 is made to be approached the lower recessed portion 22 from the outside of the cover part 15, and then magnetic repulsion is generated between the lower arm part 28 and the magnet 31. By the magnetic repulsion, the upper and lower arm parts 27 and 28 are turned such that the upper arm part 27 enters the upper recessed portion 21 while the lower arm part 27 is separated from the lower recessed portion 22. This turns the hook part 26 upward to be disengaged with the hook claw 10. However, in this case, it is impossible to hold the cover member 7 between the lower arm part 28 and the magnet 31 and to detach the cover member 7 together with the magnet 31.

In the embodiment, on the middle of the attachment of the cover member 7 to the recessed part 6, the hook part 26 of the lock member 16 is automatically engaged with the claw portion 11 of the hook claw 10 by its own weight. However, in other embodiments, the upper arm part 27 or the lower arm part 28 may be turned by use of the magnet 31 to engage the hook part 26 with the claw portion 11. In addition, the hook part 26 may be turned in the direction other than the vertical direction, for example, in the left and right direction. Alternatively, the hook part 26 may be moved linearly between the locking position and the lock releasing position. Furthermore, in other embodiment, the hook claw 10 is formed in the cover member 7 while the lock member 16 is formed in the recessed part 6.

The embodiment describes the attachment/detachment structure of the cover member 7 attached to the recessed part 6 in which a port for connecting an optional device is formed. However, the present disclosure can be applied to a cover member which protects an electrical substrate or a cover member which protects an operation part such as a lever or a button used for attaching and detaching of a photosensitive drum and a development unit of the image forming part 5. In addition, the present disclosure can be applied to a household electric appliance and an industrial equipment, instead of the image forming apparatus such as a color printer 1.

While the preferable embodiment and its modified example of the cover member attachment/detachment structure and the image forming apparatus of the present disclosure have been described above and various technically preferable configurations have been illustrated, a technical range of the disclosure is not to be restricted by the description and illustration of the embodiment. Further, the components in the embodiment of the disclosure may be suitably replaced with other components, or variously combined with the other components. The claims are not restricted by the description of the embodiment of the disclosure as mentioned above.

The invention claimed is:

1. A cover member attachment/detachment structure comprising:

a first engagement part formed in one of a portion to be protected or a cover member attached to the portion to be protected; and a second engagement part formed in the other of the portion to be protected or the cover member attached to the portion to be protected and being capable of engaging with the first engagement part, wherein the first engagement part is made of magnetic material, and movable without contact by using magnetic force from an outside of the cover member between a locking position where the first engagement part is engaged with the second engagement part and a lock releasing position where the first engagement part is disengaged with the second engagement part, wherein the first engagement part has:

a hook part which is turnable in the vertical direction around a turning shaft, an upper arm part protruding upward from the turning shaft, and a lower arm part protruding downward from the turning shaft, wherein by moving the upper arm part or the lower arm part using the magnetic force, the hook part is turned around the turning shaft so as to be engaged or disengaged with the second engagement part.

2. The cover member attachment/detachment structure according to claim 1, wherein the first engagement part is moved by magnetic attraction.

3. The cover member attachment/detachment structure according to claim 1, wherein the first engagement part is moved to the locking position by its own weight.

4. The cover member attachment/detachment structure according to claim 1, wherein the first engagement part is formed in the cover member and the second engagement part is formed in the portion to be protected.

5. The cover member attachment/detachment structure according to claim 1, wherein the first engagement part is formed by bending a wire.

6. An image forming apparatus comprising:

an image forming part which forms an image on a sheet;

an apparatus main body on which the image forming part is provided;

a portion to be protected, which is formed on the apparatus main body;

a cover member attached to the portion to be protected; and a cover member attachment/detachment structure according to claim 1, which detachably attaches the cover member to the portion to be protected.

* * * * *